United States Patent [19]

Baculo

[11] 4,185,804

[45] Jan. 29, 1980

[54] LOCK AND RELEASE FORM CLAMP

[76] Inventor: Umberto A. Baculo, 2737 NW. 17th Ter., Miami, Fla. 33126

[21] Appl. No.: 13,802

[22] Filed: Feb. 21, 1979

[51] Int. Cl.[2] ..... E04G 17/12

[52] U.S. Cl. ..... 249/20; 249/40; 249/43; 249/219 R; 264/33

[58] Field of Search ..... 249/20, 219, 40, 43; 264/33

[56] References Cited

U.S. PATENT DOCUMENTS

| | | | |
|---|---|---|---|
| 809,106 | 1/1906 | Gehr | 249/21 |
| 1,965,319 | 7/1934 | Romero | 249/213 |
| 2,298,837 | 10/1942 | Oswald | 249/5 |
| 2,358,975 | 9/1944 | Hillberg | 249/216 |
| 2,513,882 | 7/1950 | Magdiel et al. | 249/20 |
| 3,578,309 | 5/1971 | Freedman | 249/219 R |
| 4,106,746 | 8/1978 | Baculo | 249/219 |

*Primary Examiner*—William E. Schulz
*Attorney, Agent, or Firm*—Salvatore G. Militana

[57] ABSTRACT

A beam clamp for securing a concrete form in forming beams, lintels, etc. having a pair of spaced apart legs secured together by a cross bar that permits one leg to pivot toward and away from the other leg and a pivoted lever operating as a cam for pivoting the first leg when mounting and dismantling the beam clamp from a form after the concrete has been poured and set.

2 Claims, 2 Drawing Figures

LOCK AND RELEASE FORM CLAMP

BACKGROUND OF THE INVENTION

1. Field of the Invention

This invention is directed to clamps for mounting on forms used for containing poured concrete until set in the forming of concrete beams, lintels and the like.

2. Description of the Prior Art

This invention is an improvement over my U.S. Pat. No. 4,106,746, issued Aug. 15, 1978, for ADJUSTABLE FORM CLAMP, in which a form clamp is readily positioned over boards forming a concrete form for a concrete beam and adjusted in place by threading a wing nut and is as readily removed from the form after the concrete has been poured and set by unthreading the wing nut. However, problems arose when the wing nuts were loosened and removed from the clamp and eventually lost. Also, at times the nut became jammed when concrete spilled over onto the threads. The present invention contemplates avoiding the objections to the use of a threaded nut by the use of a lever operating as a cam for tightening an adjustable clamp on a concrete form and the loosening and removal of the clamp after the concrete has been poured and set.

SUMMARY OF THE INVENTION

Therefore, a principal object of the present invention is to provide a clamp for securing a concrete form with a leg which is pivoted by means of a cam-like lever for tightening the clamp onto the form before pouring the concrete and loosening and removing the clamp from the form after the concrete has been poured and become set.

Another object of the present invention is to provide a concrete form holding clamp that is tightened onto a form by pivoting a lever that is mounted on the clamp and loosened therefrom upon a reverse swinging of the lever.

A further object of the present invention is to provide a concrete beam form with a clamp that is readily manipulated for mounting and removal from the form.

A still further object of the present invention is to provide a concrete beam form with a clamp that requires no tools for mounting and removal of same from the form and which is not jammed by the spillage of concrete thereon.

With these and other objects in view, the invention will be best understood from a consideration of the following detailed description taken in connection with the accompanying drawing forming a part of this disclosure, with the understanding, however, that the invention is not confined to any strict conformity with the showing of the drawing but may be changed or modified so long as such changes or modifications mark no material departure from the salient features of the invention as expressed in the appended claims.

DESCRIPTION OF THE PREFERRED EMBODIMENT

Figure 1:
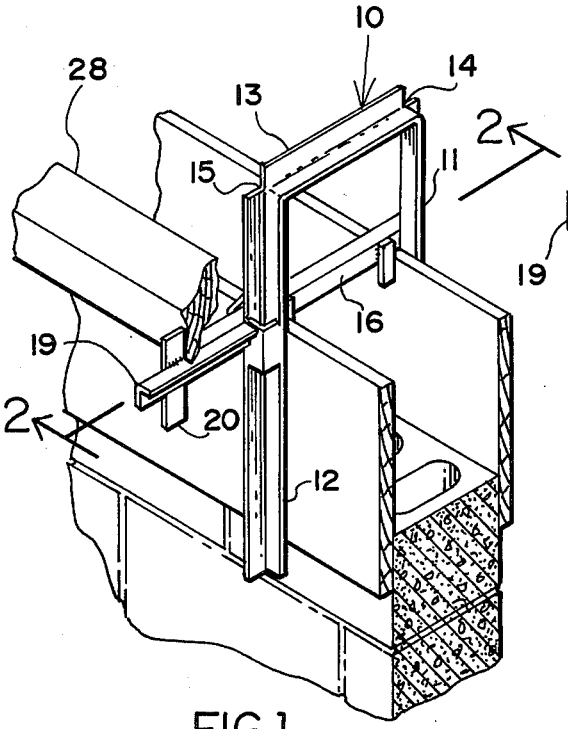
FIG. 1 is a fragmentary perspective view of a wall on which my clamp is mounted for retaining a concrete form for forming a beam.

Referring to the drawing wherein like numerals are used to designate similar parts throughout the several views, the numeral 10 refers to a concrete form clamp constructed in accordance with my invention and consisting of a pair of legs 11 and 12 connected together at their top portions by a cross member 13. In fact, the legs 11, 12 and cross member 13 are fashioned from a length of an angle bar, cut and then bent at the ends 14 and 15 of the members 11, 12 and 13, the angles at which the legs 11 and 12 are bent are exactly right angle at position 14 and slightly greater than right angle at 15.

Figure 2:
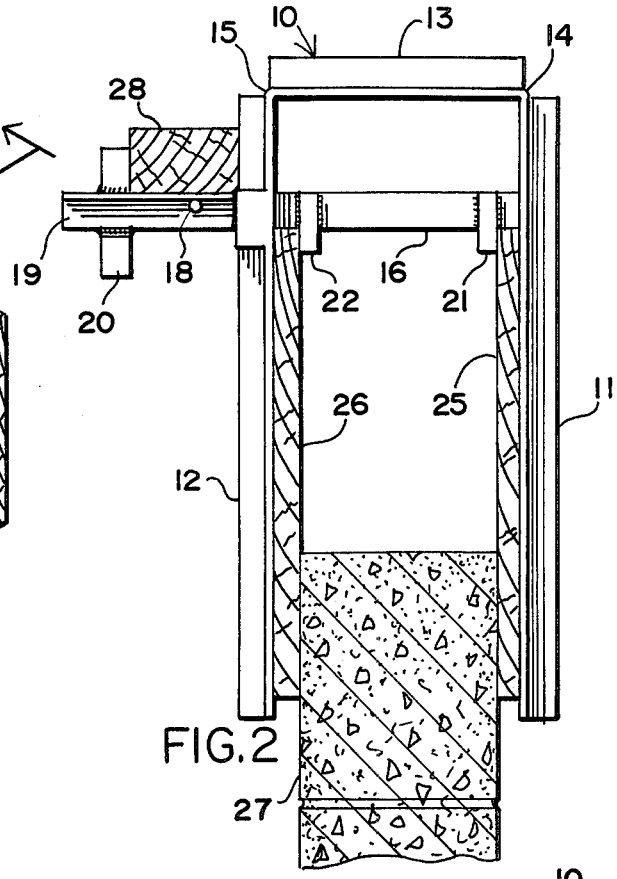
FIG. 2 is a cross sectional view taken along the line 2—2 of FIG. 1 showing the form retaining clamp is shown in its locked position.
Figure 4:
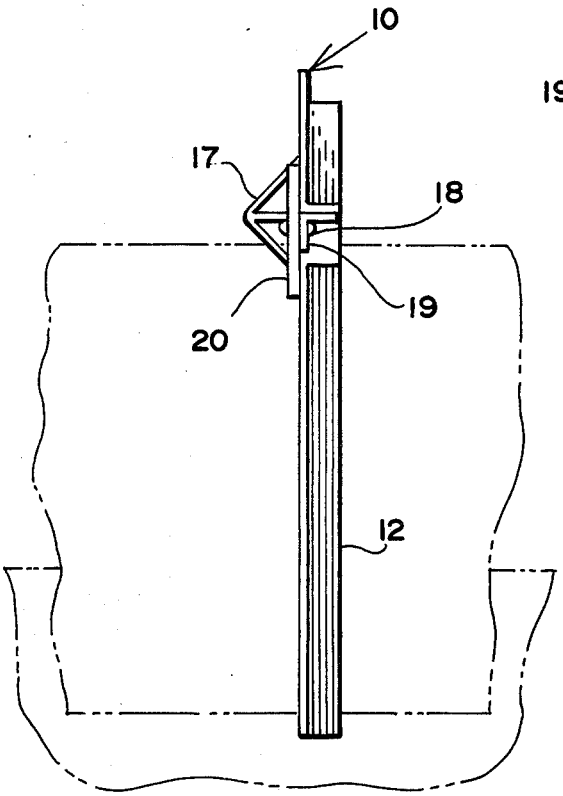
FIG. 4 is a side elevational view.

A second cross member 16 extends between legs 11 and 12 below the cross member 13. The cross member 16 is welded or otherwise secured at its end to the leg 11 while the midportion of the cross member 16 extends slidably within a sleeve 17 welded to the leg 12. Pivotally mounted as at 18 on the free end of the cross member 16 is a lever 19 having a stop member 20 welded transversely of thelever 19 at such a distance from the leg 12 to permit the four inch side of a 2×4 fit snugly therein as shown in FIG. 2.

A pair of tabs 21 and 22 are welded to the cross member 16 so as to depend below the latter and bear against the inner surfaces of wood forms 25 and 26. With the legs 11 and 12 of the clamp 10 abutting against the outside surfaces of the wood forms 25 and 26 and the tabs 21 and 22 abutting against the inside surfaces of the wood forms 25 and 26, the latter are consequently held rigidly against any movement or by any forces exerted by the concrete when poured therebetween to form the lintel on the block wall 27. The clamp 10 secures the forms 25 and 26 so rigidly to the wall 27 that there is no danger of the forms 25 and 26 slipping down out of its proper position on the wall 27.

Figure 3:
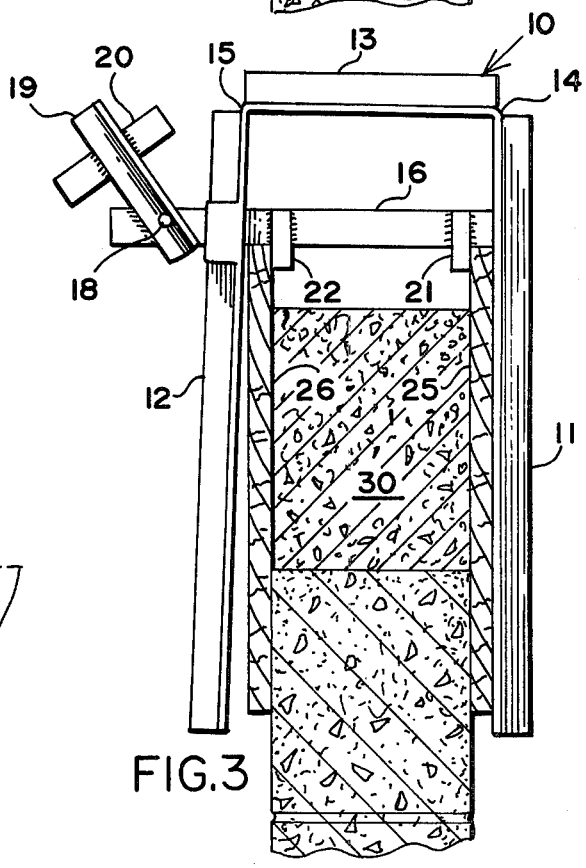
FIG. 3 is a similar view showing the clamp in the unlocked position releasing the concrete form after the poured concrete has become set.

In the normal use of my concrete form clamp 10 after the form boards 25 and 26 have been nailed in position on the block wall 27, the clamps 10 are lifted up to the form boards 25 and 26 and rested thereon with the lower end of the stop members 20 extending over the top edge of one of the form boards 26 or 26 and left hanging there until finally positioned on the form boards 25 and 26 as shown by FIG. 3. This proceedure requires the use of one less person than if the clamps 10 had to be handed up to a person standing alongside the form boards 25, 26. The legs 11 and 12 will be positioned along the outside surfaces of the form walls 25 and 26. The cross member 16 will come to rest on the top edges of the form walls 25 and 26 while the tabs 21 and 22 will engage the inner surfaces of the form walls 25 and 26 to secure the latter against any horizontal movement of the top edges of the form boards 25 and 26. The lever 19 is then pivoted downwardly about the pivot pin 18 to cause the leg 12 to swing inwardly and bear against the outside surface of the wall form 12 as shown by FIG. 2, thereby forcing the leg to pivot at the bend 15 and legs 11 and 12 become tightly engaged with the wall forms 25 and 26 as the latter are forced into tight engagement with the block wall 27. Then a 2×4 beam 28 is placed in the spaced formed by the cross beam 16 and leg 12 to bring into proper alignment all of the clamps 10 mounted on the form walls 25, 26. After the concrete lintel 30 has been poured and set, the forms 25, 26 and the clamps 10 are removed. This is accomplished quite readily by pivoting the lever 19 upwardly as shown by FIG. 3. The leg 12 springs outwardly of the wall form 26 to release the clamp from the wall forms 25 and 26. The clamps 10 are then removed from their position on the wall form 25, 26 and the wall forms 25 and 26 are stripped from the lintel 30.

What I claim as new and desire to secure by Letters Patent is:

1. A concrete form clamp for securing form walls to a building wall in preparation for pouring concrete therebetween comprising a pair of leg portions having a first cross member secured at one end of said leg portions and said leg portions extending in the same direction, one of said leg portions being at substantially right angle to said cross member, the other of said leg portions extending at a substantially slightly greater than right angle to said cross bar in a direction away from said one of said leg portions, a sleeve mounted on said other of said leg portions, a second cross member secured at one end to said one of said leg portions in spaced relation to said first cross member and its other end extending through said sleeve, a lever pivotally mounted on said free end of said second cross member, engaging said one of said leg portions and pivoting the latter into substantially parallel relation with said other of said leg portions whereby said pair of said leg portions force said form walls into engagement with said building wall.

2. The structure as recited by claim 1 taken in combination with a cross member secured to said lever in spaced relation to said other of said leg portions.

* * * * *